US009141089B1

(12) United States Patent
Liou et al.

(10) Patent No.: US 9,141,089 B1
(45) Date of Patent: Sep. 22, 2015

(54) WEARABLE DEVICE WITH ANTENNA

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 14/510,560

(22) Filed: Oct. 9, 2014

(30) Foreign Application Priority Data

Apr. 30, 2014 (CN) ..... 2014 1 0180694

(51) Int. Cl.
*G04R 60/02* (2013.01)
*G04R 60/14* (2013.01)
*G04R 60/06* (2013.01)

(52) U.S. Cl.
CPC ..... *G04R 60/06* (2013.01); *G04R 60/02* (2013.01); *G04R 60/14* (2013.01)

(58) Field of Classification Search
CPC ..... G04R 60/02; G04R 60/06; G04R 60/12; G04R 60/14
USPC ..... 368/47
See application file for complete search history.

(56) References Cited

U.S. PATENT DOCUMENTS 5,331,608 A * 7/1994 Umemoto et al. ..... 368/10
5,646,634 A * 7/1997 Bokhari et al. ..... 343/700 MS
7,433,273 B2 * 10/2008 Oguchi et al. ..... 368/47

* cited by examiner

*Primary Examiner* — Vit W Miska
(74) *Attorney, Agent, or Firm* — Novak Druce Connolly Bove + Quigg LLP

(57) ABSTRACT

A wearable device includes a dial extending a shaft; two watch hand elements coupled to the shaft and configured to rotate 360 degrees in a plane about the shaft; an antenna element coupled to the shaft and configured to rotate 360 degrees in the same plane about the shaft; and a matching circuit matching with the antenna element.

20 Claims, 4 Drawing Sheets

WEARABLE DEVICE WITH ANTENNA

FIELD

The present disclosure generally relates to a wearable device, and more particularly to a wearable device with an antenna.

BACKGROUND

A wearable device may have an appearance of a wrist watch, but has functions much more than telling time.

DETAILED DESCRIPTION

Figure 1:
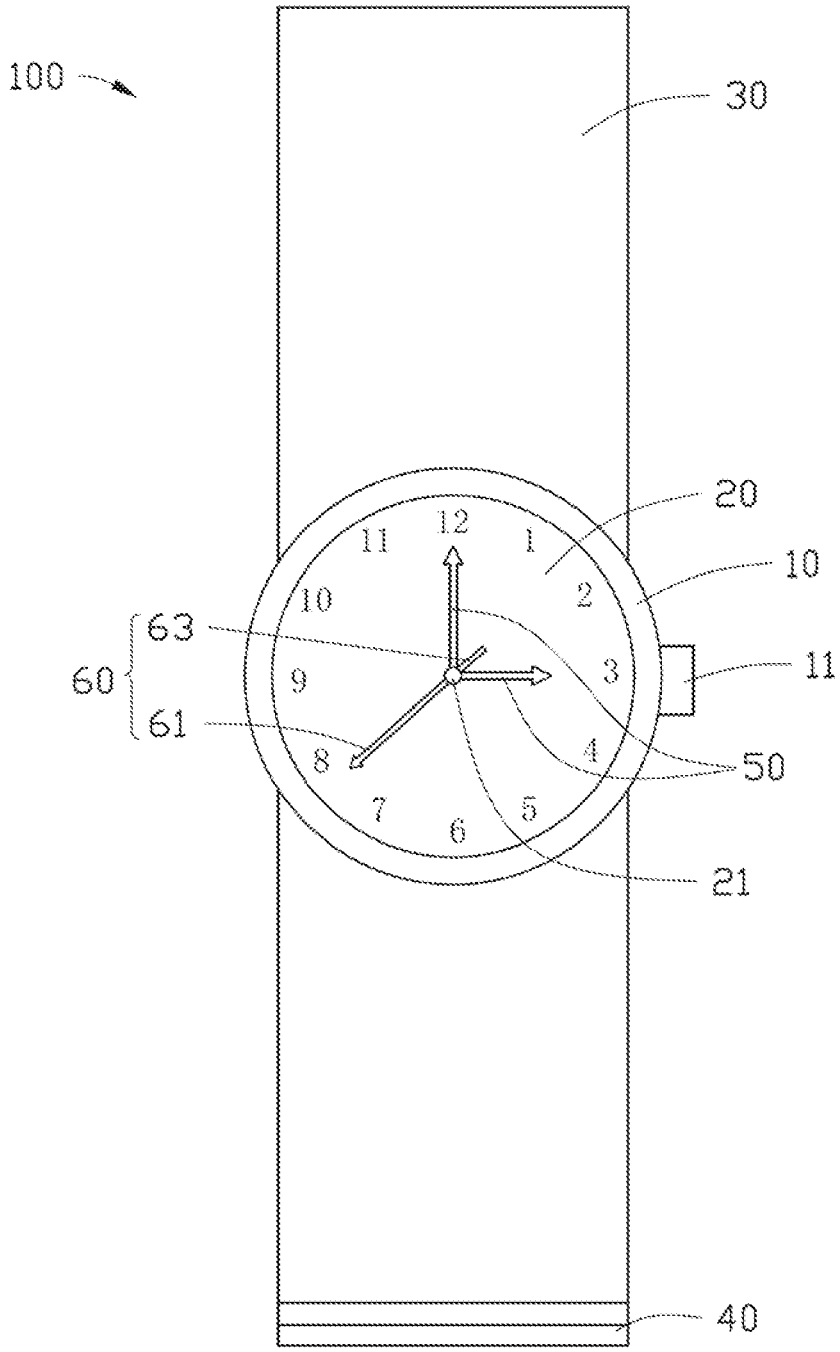
FIG. 1 is a diagrammatic view of a wearable device according to one embodiment of the subject disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

The present disclosure is described in relation to a wearable device. The wearable device can include a dial extending a shaft; two watch hand elements coupled to the shaft and configured to rotate 360 degrees in a plane about the shaft; an antenna element coupled to the shaft and configured to rotate 360 degrees in the same plane about the shaft; and a matching circuit matching with the antenna element.

The present disclosure is described further in relation to a wearable device. The wearable device can include a time display dial extending a shaft; two watch hand elements rotatably coupled to the shaft; an antenna element rotatably coupled to the shaft; and a matching circuit matching with the antenna element; wherein the two watch hand elements and the antenna element cooperatively show time of the wearable device.

Figure 2:
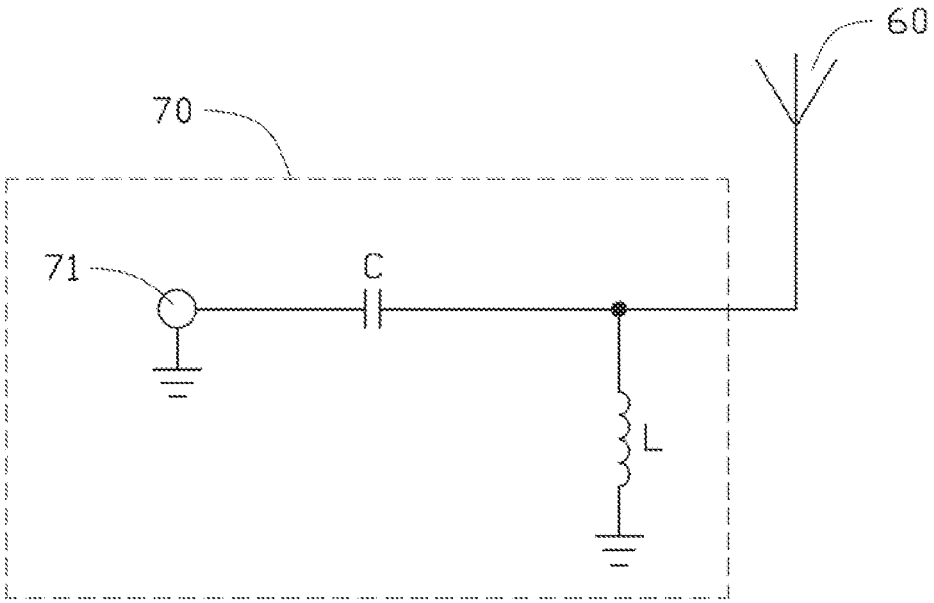
FIG. 2 is a circuit diagram of an antenna of the wearable device of FIG. 1.

FIG. 1 illustrates an embodiment of a wearable device 100. In at least one embodiment, the wearable device 100 can be a watch. The wearable device 100 has a main body 10, a dial 20 coupled to the main body 10, a band 30 coupled to the main body 10, two watch hand elements 50, an antenna element 60 and a matching circuit 70 (as shown in FIG. 2) matching with the antenna element 60.

The main body 10 can be substantially disc-shaped. The main body 10 has an outer face surface. The main body 10 has a side thereof coupled with an adjusting button 11 configured to adjust time of the wearable device 100. The main body 10 has the dial 20 mounted thereon. The dial 20 can be a time display dial. A shaft 21 extends out from the outer face surface of the main body 10. The shaft 21 can be substantially perpendicular to the outer face surface. The shaft 21 perpendicularly extends through the dial 20. The dial 20 can be positioned on the outer face surface of the main body 10 with the shaft 21 positioned in a center of the dial 20. The shaft 21 can be made from electric conducting materials.

The band 30 is attached to two opposite ends of the main body 10 and configured to attach the wearable device 100 to a user so that the outer face surface of the main body 10 is positioned facing away from the user. A buckle 40 is coupled to the band 30 for fixing the wearing device 100 to a hand of the user.

The watch hand elements 50 and the antenna element 60 are rotatably coupled to the shaft 21. The watch hand elements 50 include a first watch hand element and a second watch hand element. The first watch hand element and the second watch hand element can be an hour hand and a minute hand. The first watch hand element has a first end and a second end. The second watch hand element has a first end and a second end.

The antenna element 60 can be another watch hand element, i.e., a second hand of the wearable device 100. In at least one embodiment, the antenna element 60 can include a first end 61 and a second end 63 at two opposite sides of the shaft 21. A ratio of electrical capacitance of the first end 61 to the second end 63 can be direct proportional to a ratio of a length of the first end L1 to a length of the second end L2. A ratio of electrical inductance of the first end 61 to the second end 63 can be inverse proportional to the ratio of L1 to L2.

The first end of the first watch hand element and the first end of the second watch hand element of the watch hand elements 50 are attached to the shaft 21 so that the first watch hand element and the second watch hand element extend away from the shaft 21 substantially parallel to the outer face surface of the main body 10. The first end 61 of the antenna element 60 is attached to the shaft 21 so that the antenna element 60 extends away from the shaft 21 substantially parallel to the outer face surface of the main body 10.

Alternatively, the antenna element 60 can be an hour hand or a minute hand of the wearable device 100. The two watch hand elements 50 and the antenna element 60 cooperatively show time of the wearable device 100. Each of the first watch hand element, the second watch hand element, and the antenna element 60 are perpendicularly coupled to the shaft 21 and configured to rotate 360 degrees in a same plane about the shaft 21. The antenna element 60 can be made of material capable of wireless communications. In detail, the antenna element 60 can be made from electric conducting material.

To reduce or free from interferences with wireless communications of the antenna element 60, the watch hand elements 50 may be made of material that does not interfere with wireless communications. In one embodiment, the watch hand elements 50 may be made of plastic or coated with a non-conductive material. In detail, the watch hand elements 50 can be made from plastic material by non conductive vacuum metallization (NCVM).

FIG. 2 illustrates the matching circuit 70 for the antenna element 60. The matching circuit 70 can include a capacitance C, an inductor L and a port 71. The capacitance C has one end thereof coupled to the port 71 and another end thereof coupled to the antenna element 60. The inductor L has one end thereof coupled to a position between the capacitance C and the antenna element 60, and another end thereof grounded. The port 71 is coupled to a radio frequency (rf) transceiver circuit (not shown) of the wearable device 100. In at least one embodiment, capacity of capacitance C can be 700 pF, the inductance of the inductor L can be 1.5 nH.

In at least one embodiment, the antenna element 60 can work in two wireless communication frequency ranges. The first end 61 can work in a first wireless communication frequency range, the second end 63 can work in a second wireless communication frequency range, the first wireless communication frequency range can be different from the second wireless communication frequency range. In detail, the antenna element 60 can work in frequencies of Bluetooth and Wi-Fi. The antenna element 60 on the first end 61 communicates in frequencies in a range from 2400 MHz to 2484 MHz suitable for Bluetooth communications, and the antenna element 60 on the second end 63 communicates in frequencies in a range from 5200 MHz to 5800 MHz suitable for Wi-Fi communications. In other embodiments, the antenna element 60 may communicate in frequencies suitable for GPS. GSM, WCDMA, LTE communications.

Figure 3:
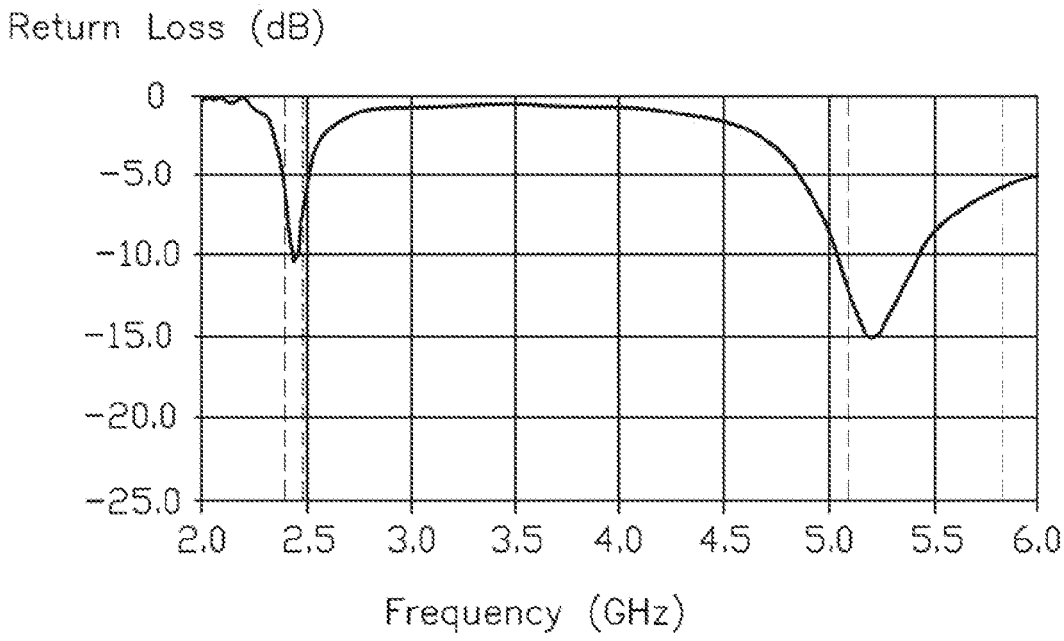
FIG. 3 is a curve graph of return loss of an antenna of the wearable device of FIG. 1.

FIG. 3 illustrates return loss of the antenna element 60. In detail, the antenna element 60 has the return loss less than −6 Db in each of the frequencies of Bluetooth (2400 to 2484 MHz) and Wi-Fi (5200 to 5800 MHz).

Figure 4:
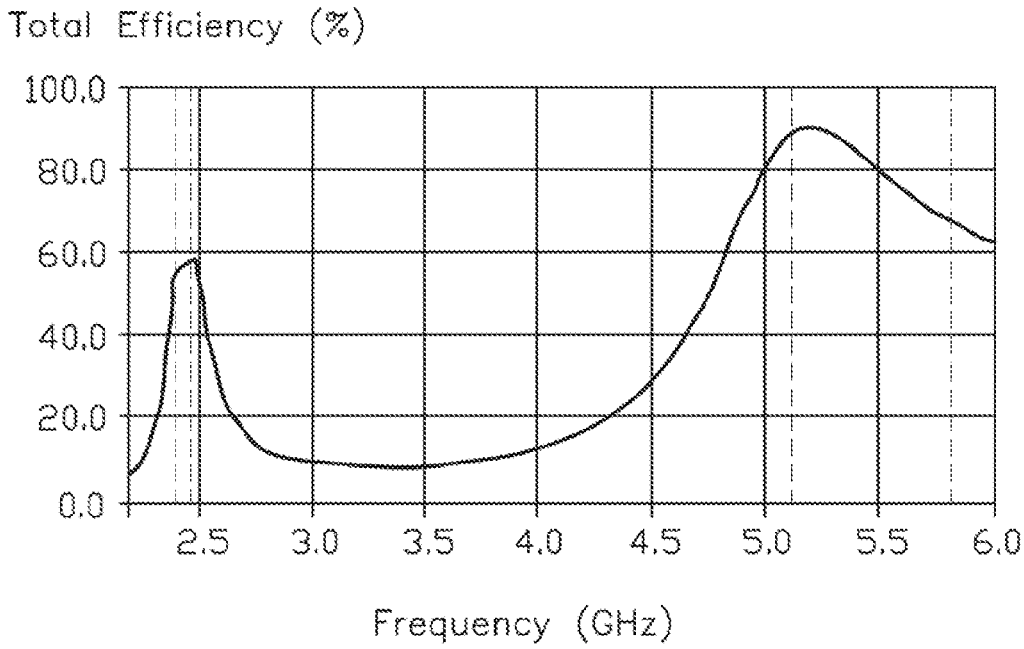
FIG. 4 is a curve graph of gross efficiency of an antenna of the wearable device of FIG. 1.

FIG. 4 illustrates total efficiency of the antenna element 60. In detail, the antenna element 60 has the total efficiency in a range from 55% to 57% in the frequencies of bluetooth (2400 to 2484 MHz), and has the total efficiency in a range from 68% to 90% in the frequencies of Wi-Fi (5200 to 5800 MHz).

The embodiments shown and described above are only examples. Even though numerous characteristics and advantages of the present technology have been set forth in the foregoing description, together with details of the structure and function of the present disclosure, the disclosure is illustrative only, and changes may be made in the details, including in matters of shape, size and arrangement of the parts within the principles of the present disclosure up to, and including, the full extent established by the broad general meaning of the terms used in the claims.

What is claimed is:

1. A wearable device comprising:
a dial extending a shaft;
two watch hand elements coupled to the shaft and configured to rotate 360 degrees in a plane about the shaft;
an antenna element coupled to the shaft and configured to rotate 360 degrees in the same plane about the shaft; and
a matching circuit matching with the antenna.

2. The wearable device of claim 1, wherein the antenna element is another watch hand of the wearable device.

3. The wearable device of claim 2, wherein the antenna element is a second hand of the wearable device, and the two watch hand elements are an hour hand and a minute hand.

4. The wearable device of claim 1, wherein the antenna element works in two wireless communication frequency ranges.

5. The wearable device of claim 4, wherein the antenna element comprises a first end and a second end at two opposite sides of the shaft.

6. The wearable device of claim 5, wherein the first end works in a first wireless communication frequency range, the second end works in a second wireless communication frequency range, and the first wireless communication frequency range is different from the second wireless communication frequency range.

7. The wearable device of claim 6, wherein the first wireless communication frequency range is from 2400 MHz to 2484 MHz.

8. The wearable device of claim 7, wherein the second wireless communication frequency range is from 5200 MHz to 5800 MHz.

9. The wearable device of claim 1, wherein the antenna element is made of electric conducting material.

10. The wearable device of claim 9, wherein the watch hand elements are made of materials which do not interfere with wireless communications.

11. A wearable device comprising:
a time display dial extending a shaft; two watch hand elements rotatably coupled to the shaft; an antenna element rotatably coupled to the shaft; and a matching circuit matching with the antenna element; wherein the two watch hand elements and the antenna element cooperatively show time of the wearable device.

12. The wearable device of claim 11, wherein the antenna element is made of material capable of wireless communications, the watch hand elements are made of material free from interferences with wireless communications.

13. The wearable device of claim 12, wherein the antenna element is one of a second hand, an hour hand and a minute hand, and the two watch hand elements are the other two of the second hand, the hour hand and the minute hand.

14. The wearable device of claim 11, wherein the antenna element comprises a first end and a second end at two opposite sides of the shaft.

15. The wearable device of claim 14, wherein a ratio of electrical capacitance of the first end to the second end is direct proportional to a ratio of a length of the first end to a length of the second end.

16. The wearable device of claim 15, wherein a ratio of electrical inductance of the first end to the second end is inverse proportional to the ratio of the length of the first end to the length of the second end.

17. The wearable device of claim 14, wherein the first end and the second end work in two different wireless communication frequency ranges.

18. A wearable device comprising:
a main body having an outer face surface;
a band attached to the main body and configured to attach the device to a user so that the outer face surface is positioned facing away from the user;
a rotatable shaft extending out from the outer face surface of the main body;
a first watch hand element, the first watch hand element having a first end and a second end;
a second watch hand element, the second watch hand element having a first end and a second end; and
an antenna element with a first end and a second end;
wherein, the shaft is substantially perpendicular to the outer face surface;

wherein, the first end of the first watch hand element and the first end of the second watch hand element are attached to the shaft so that the first watch hand element and the second watch hand element extend away from the shaft substantially parallel to the outer face surface of the main body; and wherein, the first end of the antenna element is attached to the shaft so that the antenna element extends away from the shaft substantially parallel to the outer face surface of the main body.

19. The wearable device of claim 18 further comprising a circuit connected to the antenna element.

20. The wearable device of claim 19, wherein a dial is positioned on the outer face surface of the main body with the shaft positioned in the center of the dial.

* * * * *